US005342996A

United States Patent [19]

Ito

[11] Patent Number: 5,342,996

[45] Date of Patent: Aug. 30, 1994

[54] INTER-CONNECTING TERMINAL

[75] Inventor: Akira Ito, Yokkaichi, Japan

[73] Assignee: Sumitomo Wiring Systems, Ltd., Mie, Japan

[21] Appl. No.: 979,259

[22] Filed: Nov. 20, 1992

[30] Foreign Application Priority Data

Nov. 26, 1991 [JP] Japan ..... 3-096976[U]

[51] Int. Cl.[5] ..... H01R 4/18

[52] U.S. Cl. ..... 174/84 C; 174/94 R; 439/877; 439/882

[58] Field of Search ..... 174/84 C, 94 R; 439/880, 877, 878, 879, 882; 29/868, 871, 872, 882, 863

[56] References Cited

U.S. PATENT DOCUMENTS

| | | | |
|---|---|---|---|
| 3,538,239 | 11/1970 | Renshaw, Jr. | 174/75 |
| 3,541,227 | 11/1970 | Bendrick | 174/75 |
| 3,777,302 | 12/1973 | Travis . | |
| 3,916,085 | 10/1975 | Hansen | 174/84 C |
| 4,235,497 | 11/1980 | Simon | 439/877 X |
| 4,692,122 | 9/1987 | Montalbano | 29/863 X |
| 4,950,186 | 8/1990 | Kaley et al. | 439/882 |
| 4,951,389 | 8/1990 | Kaley et al. | 439/882 X |

FOREIGN PATENT DOCUMENTS

| | | | |
|---|---|---|---|
| 1540556 | 1/1970 | Fed. Rep. of Germany | 439/877 |
| 2539323 | 3/1976 | Fed. Rep. of Germany | 174/84 C |
| 1231193 | 5/1971 | United Kingdom | 174/84 C |

*Primary Examiner*—Mark Rosenbaum
*Assistant Examiner*—S. Thomas Hughes
*Attorney, Agent, or Firm*—Sughrue, Mion, Zinn, Macpeak & Seas

[57] ABSTRACT

An inter-connecting terminal has a barrel formed U-shape in the sectional configuration thereof, into which a core wire exposed at an intermediate portion of a first electric wire and a core wire exposed at an end of a second electric wire are inserted. Side walls of the barrel are pressed against the core wires inserted into the barrel so as to fix and contact with the core wires. A V-shaped stopper is formed integral with the terminal and extended from the front end of the bottom of the barrel and bent backward so as to insert the end portion of the core wire of the second electric wire.

5 Claims, 4 Drawing Sheets

INTER-CONNECTING TERMINAL

BACKGROUND OF THE INVENTION

1. Field of the Invention

The present invention relates to an inter-connecting terminal and more particularly to an inter-connecting terminal comprising a core wire-pressing barrel accommodating a core wire exposed in an intermediary portion of an electric wire and a core wire exposed at an end of another electric wire. The barrel is pressed by a presser to deform the barrel so that the electric wires are fixed to the terminal under pressure.

2. Description of the Related Arts

A conventional inter-connecting terminal to be used to connect core wires of electric wires of a wire harness for use in an automobile or an office equipment has a construction as shown in FIG. 4.

That is, a conductive metal plate is formed into an inter-connecting terminal, approximately U-shaped in its sectional configuration, consisting of a bottom 2 in a circular arc configuration and side walls 3A and 3B projecting upward from the bottom 2.

As shown in FIG. 4, a core wire 5 exposed in an intermediate portion of an electric wire W1 and a core wire 5' exposed at an end of an electric wire W2 are inserted into the space surrounded with the bottom 2 and the side walls 3A and 3B. Then, the side walls of terminal 1 are pressed to connect the electric wires W1 and W2 with each other and the side walls and to fix the wires to the terminal 1.

In a widely accepted method for fixing the core wires 5 and 5' to the terminal 1, the core wire 5 of the electric wire W1 and the core wire 5' of the electric wire W2 vertically held are inserted into the space of the inter-connecting terminal 1 placed on a fixed anvil 7 of a presser 6 as shown in FIGS. 5 and 6. Then, a crimper 8 is moved downward to deform the side walls 3A and 3B. In this manner, the core wires 5 and 5' are connected with each other and the side walls 3A and 3B and fixed to the terminal 1 as shown in FIG. 4.

It is necessary to insulate the terminal 1 and a necessary portion of the electric wires W1 and W2 after the core wires 5 and 5' are fixed to the terminal 1. As insulating methods, molding or welding is adopted to insulate the necessary portion. In addition, an insulating tube or an insulating case is used to cover the necessary portion. The method as shown in FIG. 7 is most widely adopted. That is, the necessary portion is covered with an adhering vinyl tape 9, which is inexpensive.

However, the above-described conventional inter-connecting terminal 1 has the following problem: It is difficult to position the core wires 5 and 5' appropriately in the space of the terminal 1. That is, the core wire 5' cannot be projected from the front end of the terminal 1 at a predetermined length ((G) shown in FIG. 6).

In addition, in the process of compressing the core wires 5 and 5' during the processes of pressing and insulating, there is a possibility that the leading end portion of the core wire 5' is curved at an angle of $\theta$ as shown in FIG. 8. If the electric wires W1 and W2 and terminal 1 are covered with the adhering vinyl tape 9 to insulate them with the leading end portion of the core wire 5' curved, there is a possibility of the core wire 5' breaking the adhering vinyl tape 9 as shown in FIG. 9.

The core wire 5' which has broken the adhering vinyl tape 9 may cause a circuit adjacent thereto to be shorted.

SUMMARY OF THE INVENTION

It is an object of the present invention to provide an inter-connecting terminal which facilitates the positioning of a core wire exposed at an end of an electric wire inserted in the space thereof while the terminal is pressed by a presser.

It is another object of the present invention to provide an inter-connecting terminal which allows an end portion of the core wire exposed at an end of an electric wire to be projected at a predetermined length from the front end of the terminal.

It is still another object of the present invention to provide an inter-connecting terminal which prevents the curving of an end portion of the core wire exposed at an end of an electric wire, so that the core wire is prevented from projecting from the front end of the terminal and breaking through an insulating tape.

In accomplishing these and other objects of the present invention, there is provided an inter-connecting terminal comprising a barrel, having a U-shaped sectional configuration, into which a core wire exposed at an intermediate portion of a first electric wire and a core wire exposed at an end of a second electric wire are inserted, wherein the core wire of the second electric wire is inserted into a V-shaped stopper, integral with the barrel, extending from the front end of the bottom of the barrel and bent backward.

According to the above-described construction, since the stopper is formed at the front end of the barrel, the leading end of the core wire of the second electric wire can be easily inserted into the stopper at an appropriate position during pressing operation and further, the core wire of the second electric wire can be projected from the front end of the barrel in a predetermined length. In addition, the stopper protects the leading end portion of the core wire projecting from the front end of the barrel and prevents the core wire from being curved at the leading end thereof. Accordingly, an insulating tape which is to be wound around the first and second electric wires and the terminal can be prevented from being broken by the front portion of the core wire of the second electric wire and thus a circuit adjacent to the core wire can be prevented from being shorted.

Preferably, the stopper extends backward into the space surrounded with the side walls of the barrel so that the core wire of the first electric wire is inserted into the space disposed above the stopper; and serrations are formed on the upper and lower surfaces of the stopper.

According to this construction, the serrations shear the oxide films of the core wires of the first and second electric wires in contact with the upper and lower surfaces of the stopper, respectively from the core wires. Thus, the core wires are electrically connected with the terminal via the stopper.

Preferably, the core wire of the second electric wire is projected from the front end of the barrel in the length of 0.1 mm to 3 mm. It is preferable that the stopper is interposed as far as the rear end of the barrel so that the core wires can contact the serrations in a larger area.

The serrations formed on the upper and lower surfaces of the stopper spaced at certain intervals may be arranged vertically, horizontally or inclined or may consist of a plurality of circular or rectangular grooves so long as they shear the oxide films formed on the surface of each core.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
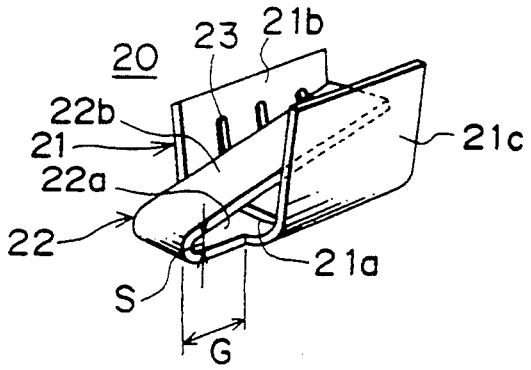
FIG. 1 is a perspective view showing an interconnecting terminal according to a first embodiment of the present invention.

Before the description of the present invention, it is to be noted that like parts are designated by like reference numerals throughout the accompanying drawings. The embodiments of the present invention will be described below with reference to the drawings.

Figure 2:
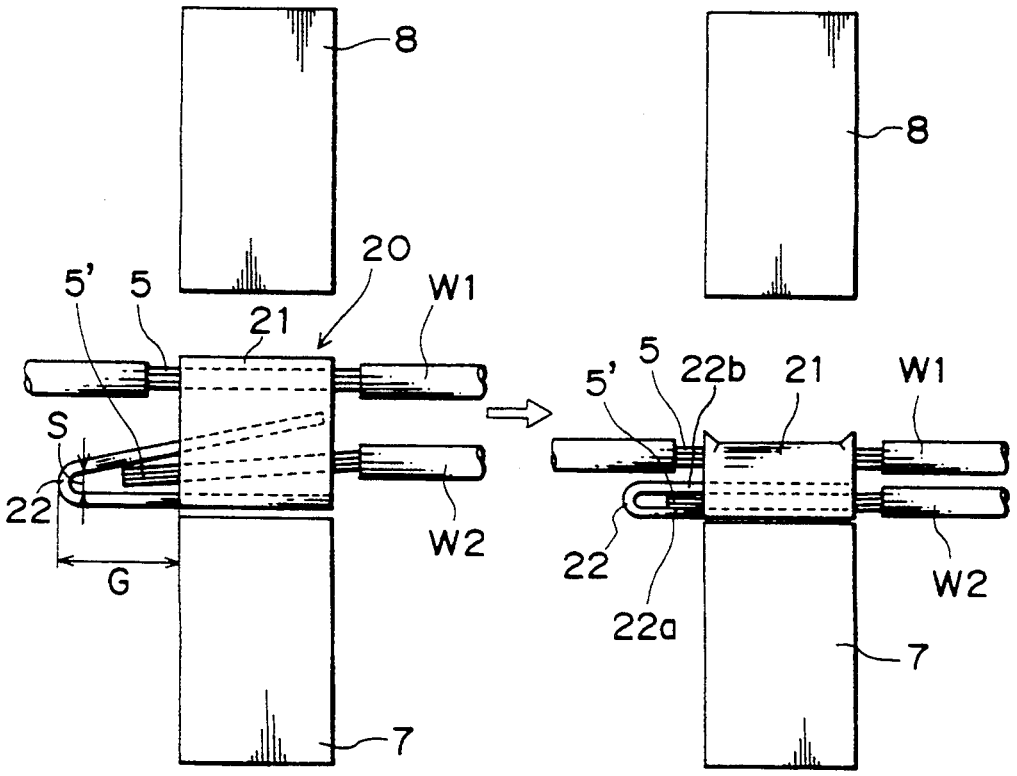
FIG. 2 is a view showing a pressing process according to the first embodiment.

FIGS. 1 and 2 show a first embodiment. A material such as a conductive metal plate is formed into an interconnecting terminal 20 comprising a stopper 22 and a core wire-pressing barrel 21 integral with the stopper and approximately U-shaped in its sectional configuration.

Serrations 23 consisting of grooves are formed on the inner surface of a bottom 21*a* of the barrel 21 and that of side walls 21*b* and 21*c* thereof. The serrations 23 are spaced at certain intervals in the longitudinal direction of the barrel 21 as shown in FIG. 1.

The stopper 22 consisting of a narrow plate projects by a predetermined length (G) forward from the front end of the bottom 21*a* to form a forward projection portion 22*a* and bent backward to form a backward bent portion 22*b* so that the stopper 22 is approximately V-shaped. Preferably, the projection length (G) of the stopper 22 is in the range from 0.1 mm to 3 mm. It is 2 mm in this embodiment. The forward projection portion 22*a* is bent upward toward the rear of the barrel 21 to form a space (S) between the forward projection portion 22*a* and the backward bent portion 22*b* so as to insert the core wire 5' exposed at an end of the electric wire W2 thereinto.

The backward bent portion 22*b* is disposed between the side walls 21*b* and 21*c* so as to partition the space surrounded with the bottom 21*a* and the side walls 21*b* and 21*c* into an upper space and a lower space.

In fixing the electric wires W1 and W2 to the terminal 20, the core wire 5' of the electric wire W2 is inserted between the bottom 21*a* of the barrel 21 and the backward bent portion 22*b* of the stopper 22, namely, the lower space of the barrel 21 so as to bring the leading end of the core wire 5' into contact with the front end of the forward projection portion 22*a*. The core wire 5' of the electric wire W2 can be easily inserted into the lower space of the barrel 21 from the backward direction because the entire space between the forward projection portion 22*a* and the backward bent portion 22*b* is wide due to the upward inclination of the backward bent portion 22*b*.

Then, the core wire 5 exposed in an intermediate portion of the electric wire W1 is inserted into the space above the backward bent portion 22*b*, namely, the upper space of the barrel 21.

Figure 5:
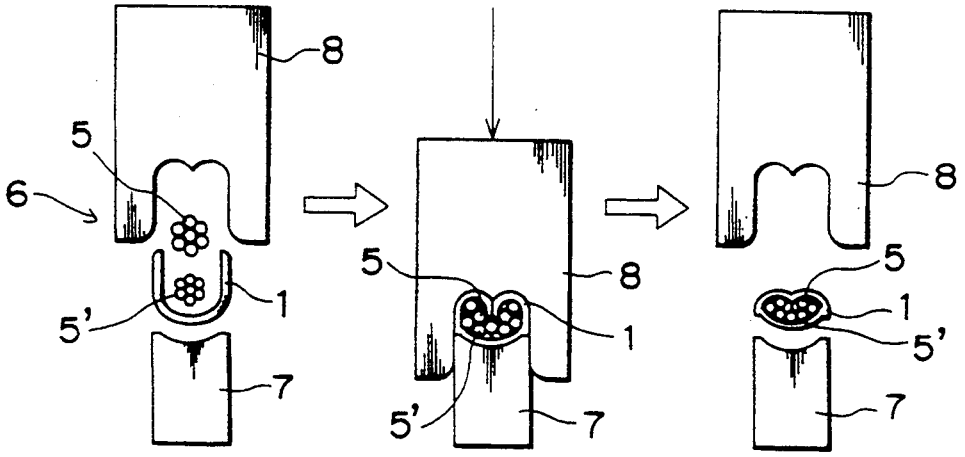
Fig.5 Prior Art
FIG. 5 is a view showing a pressing process carried out by a presser.
Figure 6:
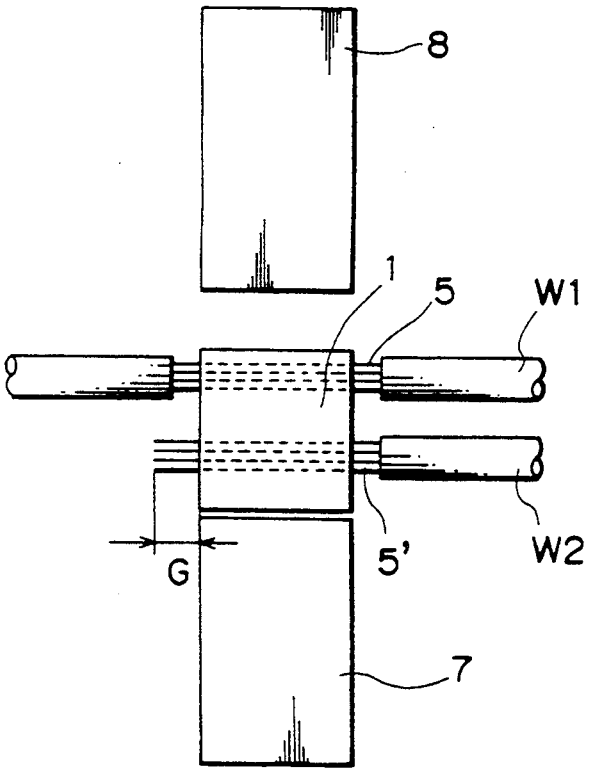
Fig.6 Prior Art
FIG. 6 is a view showing the pressing process carried out by the presser.
Figure 8:
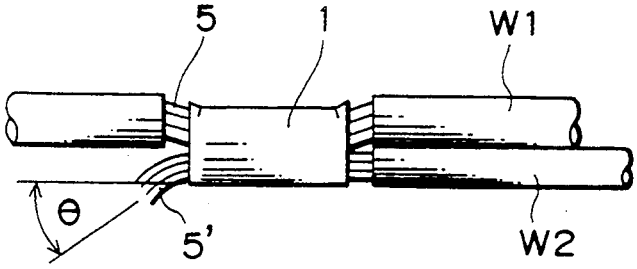
Fig.8 Prior Art
FIG. 8 is a front view showing a problem of the conventional inter-connecting terminal.
Figure 9:
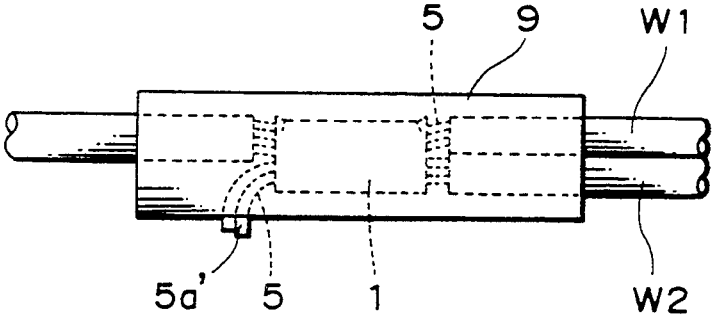
Fig.9 Prior Art
FIG. 9 is a front view showing the problem of the conventional inter-connecting terminal.

Thereafter, the core wires 5 and 5' are fixed to the terminal 20 by a presser as shown in FIGS. 5 and 6, similar to the conventional method previously described. More specifically, the crimper 8 is moved downward to press the side walls 21*b* and 21*c* of the terminal 20 placed on the anvil 7. As a result, the side walls 21*b* and 21*c* are deformed under pressure, thus pressing the core wires 5 and 5' downward and interposing the backward bent portion 22*b* between the side walls 21*b* and 21*c*.

While the side walls 21*b* and 21*c* are being pressed against the core wires 5 and 5', the core wires 5 and 5' contact the serrations 23 of the barrel 21. As a result, the serrations 23 shear the oxide film formed on the surface of the core wires 5 and 5'. Thus, the core wires 5 and 5' are favorably electrically connected with the terminal 20.

Since the core wire 5' projecting from the front end of the barrel 21 is surrounded with the stopper 22, the leading end of the core wire 5' can be prevented from being curved during the pressing operation. Therefore, an insulating tape which is to be wound around the electric wires W1, W2 and the terminal 20 can be prevented from being broken by the front portion of the core wire 5'.

Figure 3A:
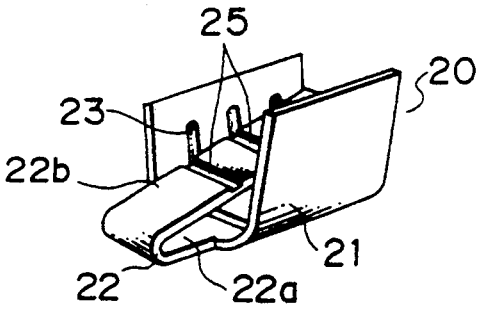
FIGS. 3A and 3B are perspective views showing an inter-connecting terminal according to a second embodiment and a third embodiment of the present invention, respectively.

A second embodiment of the present invention will be described below with reference to FIG. 3A. In the second embodiment, serrations 25 are formed on the upper and lower surfaces of the backward bent portion 22*b* interposed between the side walls 21*b* and 21*c* in addition to the serrations 23 formed on the inner surface of the bottom 21*a* and that of side walls 21*b* and 21*c*.

Owing to the increase of the serrations 25, the oxide film formed on the core wires 5 and 5' can be more effectively sheared therefrom. Thus, the core wires 5 and 5' can be electrically connected with each other via the stopper 22 with more effect. That is, the terminal 20 and the electric wires W1 and W2 can be more favorably connected with each other.

Figure 3B:
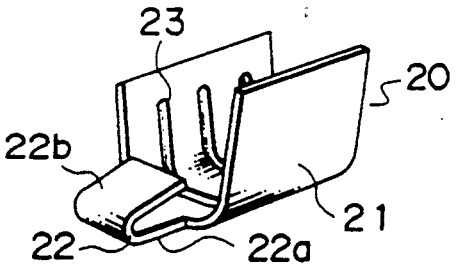
Figure 4:
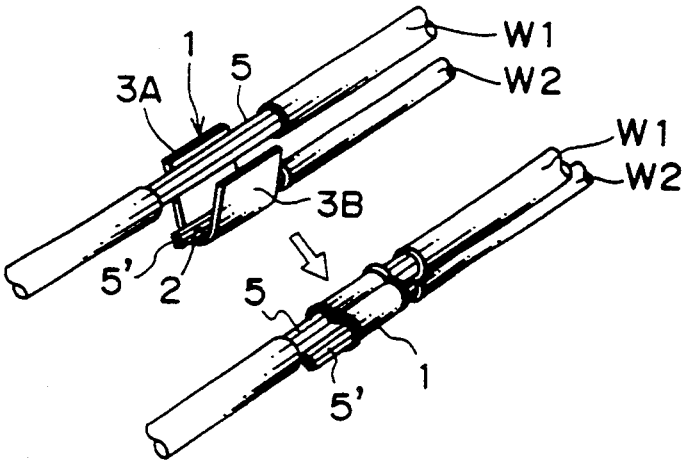
Fig.4 Prior Art
FIG. 4 is a perspective view showing a conventional inter-connecting terminal.
Figure 7:
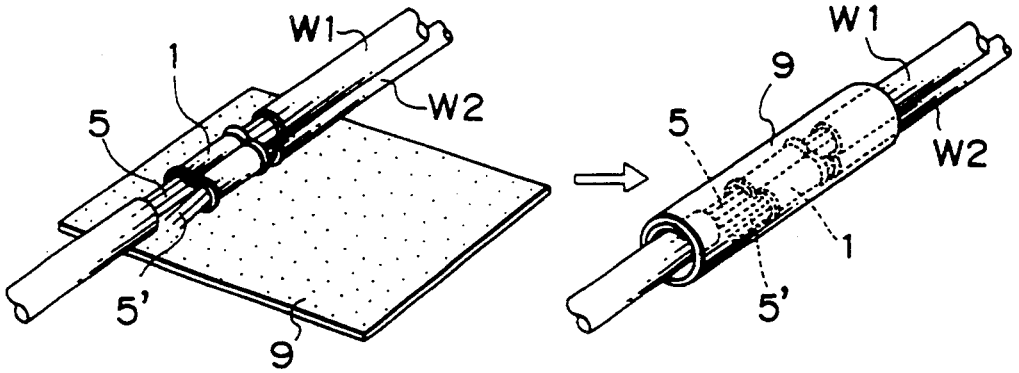
Fig.7 Prior Art
FIG. 7 is a perspective view showing a state in which an insulating tape is wound around an inter-connecting terminal.

A third embodiment is described below with reference to FIG. 3B. In the third embodiment, the backward bent portion 22*b* is not interposed between the side walls 21*b* and 21*c* so as to project the leading end of the core wire 5' in a predetermined length from the front end of the barrel 21 and prevent the core wire 5' from being curved at the leading end thereof.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An inter-connecting terminal comprising a barrel having a U-shaped sectional configuration with side walls and a bottom, into which a core wire exposed at an intermediate portion of a first electric wire and a core wire exposed at an end of a second electric wire are inserted, said side walls of said barrel being pressed against said core wires inserted into said barrel so as to fix and contact said barrel with said core wires, further comprising a V-shaped stopper formed integrally with said terminal and extending from a front end of said bottom of said barrel and bent backwardly, such that said end portion of the core wire of said second electric wire is inserted into said V-shaped stopper, wherein said stopper extends backwardly into a space surrounded with the side walls of said barrel so that the core wire of said first electric wire is inserted into a space above said stopper and between said side walls; and the core wire of said second electric wire is inserted into the space between said stopper and said bottom.

2. An inter-connecting terminal as defined in claim 1, wherein said stopper includes upper and lower surfaces and wherein serrations are formed on the upper and lower surfaces of said stopper.

3. An inter-connecting terminal as defined in claim 2, wherein serrations are formed on inner surfaces of the side walls and the bottom of said barrel

4. An inter-connecting terminal as defined in claim 1, wherein serrations are formed on inner surfaces of the side walls and the bottom of said barrel.

5. An inter-connecting terminal as defined in claim 1, wherein said terminal and the end portions of said first and second wires connected with said terminal are covered with an adhering vinyl tape.

* * * * *